US006884932B2

(12) United States Patent
Wrona et al.

(10) Patent No.: US 6,884,932 B2
(45) Date of Patent: Apr. 26, 2005

(54) STRINGED INSTRUMENT TRUSS ASSEMBLY

(76) Inventors: Michael Wrona, 907 Escarpment Dr., Lewiston, NY (US) 14092; Glen Allen Miller, 907 Escarpment Dr., Lewiston, NY (US) 14092

( * ) Notice: Subject to any disclaimer, the term of this patent is extended or adjusted under 35 U.S.C. 154(b) by 34 days.

(21) Appl. No.: 10/435,795

(22) Filed: May 12, 2003

(65) Prior Publication Data

US 2004/0226432 A1 Nov. 18, 2004

(51) Int. Cl.[7] ..... G10D 3/00
(52) U.S. Cl. ..... 84/291; 84/293; 84/313; 84/314 N
(58) Field of Search ..... 84/291, 293, 313, 84/314 N

(56) References Cited

U.S. PATENT DOCUMENTS 3,443,018 A * 5/1969 Krebs ..... 84/741
4,681,009 A * 7/1987 Mouradian ..... 84/293
4,843,941 A * 7/1989 Nichols et al. ..... 83/313
5,127,299 A * 7/1992 Stroh et al. ..... 84/314 N

* cited by examiner

*Primary Examiner*—Shih-Yung Hsieh
(74) *Attorney, Agent, or Firm*—Phillips Lytle LLP

(57) ABSTRACT

An improved musical instrument (15) having a body (16), an elongated neck (18) connected to the body, a top-nut (19) supported by the neck, a bridge (20) supported by the body, and a truss (21) in mechanical engagement with the bridge and the top-nut. The truss may comprise a truss rod (22) extending longitudinally between the top-nut and the bridge.

14 Claims, 8 Drawing Sheets

STRINGED INSTRUMENT TRUSS ASSEMBLY

TECHNICAL FIELD

The present invention relates generally to the field of stringed instruments and, more particularly, to an instrument having a truss rod assembly which provides for improved audio sustain.

BACKGROUND ART

Truss rod assemblies for stringed instruments, such as guitars, are known in the prior art. Conventional guitars generally include a truss rod which extends the length of the neck of the guitar. However, such conventional truss rod assemblies do not have a truss rod that extends beyond the point at which the neck of the guitar is connected to the body of the guitar. Furthermore, the strings in a conventional guitar generally ride on a top-nut at the end of the neck that is independent of the truss rod and on a bridge located on the body of the guitar that is also independent of the truss rod. The top-nut and bridge are therefore separated by a mass of wood, which results in a dampening affect with respect to the action of the strings and the sustain of a musical note. The length of time a player can expect the instrument to ring with a musical note is therefore limited. Accordingly, it would be beneficial to have a stringed instrument which provides a greater sustain to the musical notes that are played.

DISCLOSURE OF INVENTION

With parenthetical reference to the corresponding parts, portions or surfaces of the disclosed embodiment, merely for the purpose of illustration and not by way of limitation, the present invention provides an improved musical instrument (15) comprising a body (16), an elongated neck (18) connected to the body, a top-nut (19) supported by the neck, a bridge (20) supported by the body, and a truss (21) in mechanical engagement with the bridge and the top-nut. The truss may comprise a truss rod (22) extending longitudinally between the top-nut and the bridge. The truss rod may be an elongated steel member and may have an annular cross section. The stringed instrument may further comprise a plurality of strings (23) mounted in tension relationship over at least a portion of the neck and the body and supported at least in part by the top-nut and the bridge, and the bridge may comprise a base secured to the body and a saddle (25) for receiving the strings and an arm (26) configured and arranged to pivot the saddle in a first direction for decreasing the tension in the strings. The truss rod assembly may comprise a truss force-transfer member (28) mounted to the truss rod and the bridge may comprise a saddle force-transfer member (29), and a spring (30) may act between the truss force-transfer member and the saddle force-transfer member. The spring may be in compression between the truss force-transfer member and the saddle force-transfer member, and the pivotal movement of the saddle in the first direction may cause compression of the spring. The truss force-transfer member may be adjustably mounted for longitudinal movement along at least a portion (31) of the truss rod and the force of the spring may be a function of the longitudinal position of the truss force-transfer member on the truss rod. The spring may be a coiled spring and the truss rod may extend along the center line (x—x) of the coil.

The top-nut may have a head side (32) and an opposing neck side (33) and a through-passage (34) between the sides, the truss rod may extend through the through-passage and have a portion (35) projecting on the head side, the projecting portion of the truss rod threaded (36) to receive a corresponding threaded adjustment nut (38), and the adjustment nut may be in threaded engagement with the truss rod whereby the tension of the truss rod is adjusted by selective rotation of the adjustment nut. The adjustment nut may have a threaded first portion (39) and a second portion comprising a recess (40) for receiving a torque-producing tool.

The top-nut may comprise a lower portion (41) secured to the neck, an upper portion (42) adjustable relative to the lower portion, and at least one upper pin (44), the upper pin and the upper portion in threaded engagement such that the upper portion moves relative to the lower portion with selective rotation of the upper pin.

The stringed instrument may further comprise a plurality of strings mounted in tension relationship over at least a portion of the neck and the body and supported at least in part of the bridge, a pick-up (45) supported by the body and positioned between the body and the strings, the pick-up having a top surface (46) and the instrument having a pick-up tilt adjustment mechanism (48) for adjusting the angle of the top surface relative to the plane of the strings. The pick-up may comprise a support plate (49) configured to pivot about a pivot line (50) and the tilt adjustment mechanism may comprise at least one spring (53) between the body and the support plate on a first side (51) of the pivot line and a selectively adjustable member (55) between the body and the support plate on the opposite side (52) of the pivot line from the first side. The adjustable member and the body may be in threaded engagement such that the force of the spring on the support plate is a function of the rotation of the adjustable member. The adjustable member and the body may be in threaded engagement such that the angle of the top surface relative to the plane of the strings is a function of the rotation of the adjustable member. The stringed instrument may further comprise a height adjustment mechanism (56) for adjusting the distance between the top surface and the plane of the strings.

Accordingly, the general object of the present invention is to provide an improved stringed instrument which allows for greater sustain of the notes played on the instrument.

Another object is to provide an improved stringed instrument in which the instrument's top-nut and bridge are mechanically connected by a truss rod assembly.

Another object is to provide a stringed instrument in which the top-nut and bridge are connected by a truss that integrates them into a single mechanical unit and provides a pathway for the movement of energy and vibrations.

Another object is to provide a stringed instrument in which the truss rod extends beyond the top-nut of the instrument.

Another object is to provide a stringed instrument with a truss rod tensioning assembly which tensions against the top-nut.

Another object is to provide a stringed instrument with a tremolo in mechanical communication with the truss rod.

Another object is to provide a stringed instrument with a tremolo spring that is compressed to decrease tension in the strings of the instrument.

Another object is to provide a stringed instrument with the tilt and height of the electronic pick-up for the instrument adjustable relative to the strings or body, respectively.

Another object is to provide a stringed instrument with a improved connection between the neck and body of the instrument.

DESCRIPTION OF THE PREFERRED EMBODIMENT

Figure 1:
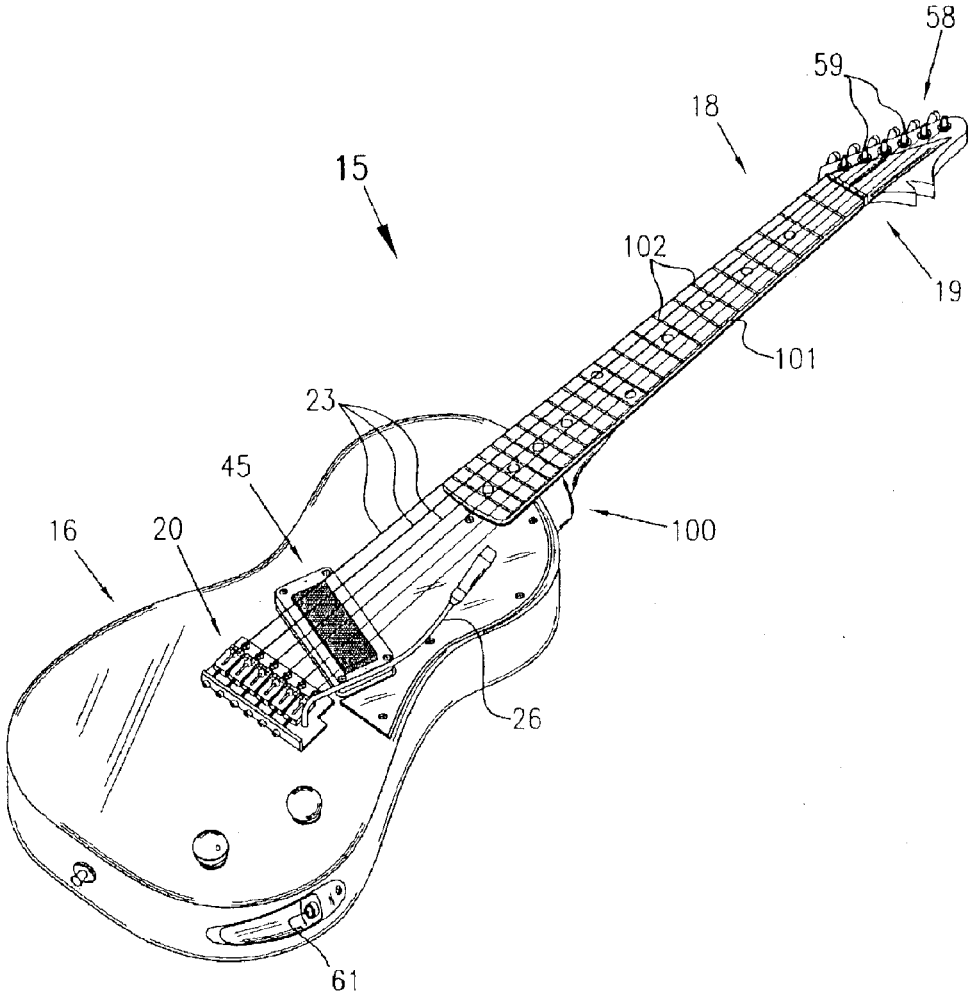
FIG. 1 is a perspective view of the improved stringed instrument.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings and, more particularly, to FIG. 1 thereof, this invention provides a musical instrument having improved sustain characteristics, the presently preferred embodiment of which is generally indicated at 15. Sustain means the length of time the guitar rings after a note is played and is a function of the rate at which a note decays after it is played.

Figure 2:
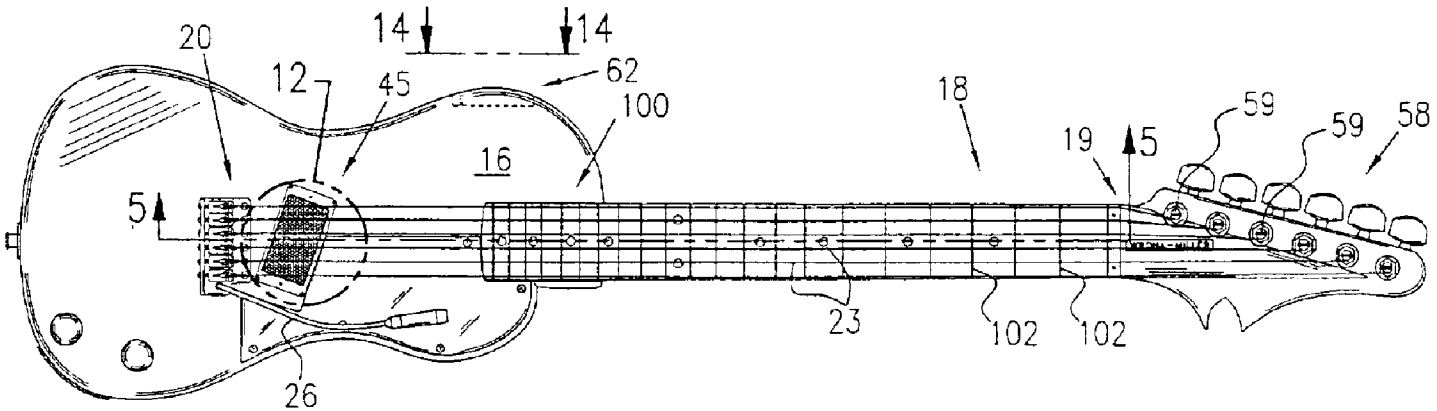
FIG. 2 is a top plan view of the improved instrument shown in FIG. 1.
Figure 3:
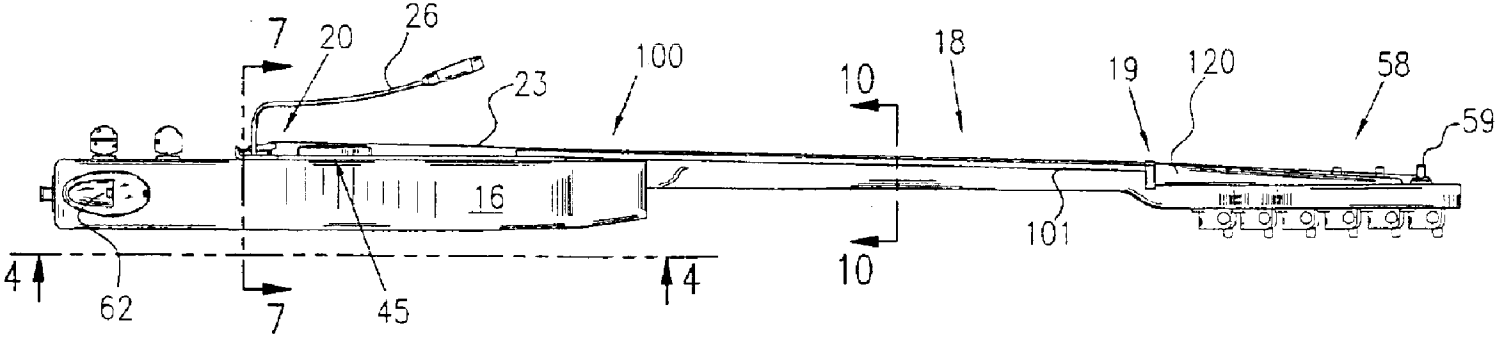
FIG. 3 is a front elevation of the instrument shown in FIG. 1.

As shown in FIGS. 1–3, instrument 15 is an electric guitar generally having a body 16 and a neck 18. Body 16 is a contoured wooden member having a number of cavities and taped holes formed to receive certain elements of hardware. A bridge 20 is mounted to body 16.

Neck 18 is a wooden element separable from body 16. Neck 16 includes head end 58, which supports tuning posts 59, a heel end 100 set into body 16, and a fretboard 101. Fretboard 101 include a number of frets 102 positioned to protrude above the fretboard surface and spaced at precise distances along fretboard 101 so as to correspond with notes of a musical scale.

A plurality of strings 23 extend from tuning posts 59 over top-nut 19 to bridge 20. Strings 23 are in a generally parallel arrangement and are in tension between posts 59 and anchors in bridge 20. Springs 23 are tuned by adjusting tuning posts 59. Strings 23 extend over the surface of fretboard 101 at a controlled height, typically being closer to fretboard 101 near top-nut 19 than they are near body 16. As described in further detail below, top-nut 19 allows for the adjustment of the height of strings 23 above fretboard 101 near top-nut 19.

A pick-up 45 is located beneath strings 23 on body 16 between heel 100 and bridge 20. As further shown in FIG. 15, a volume control 62 is recessed into body 16 for controlling the volume of pick-up 45. An outlet jack 61 is set into body 16 for connecting pick-up 45, volume control 62, and other conventional controls to a suitable amplifier.

Figure 5:
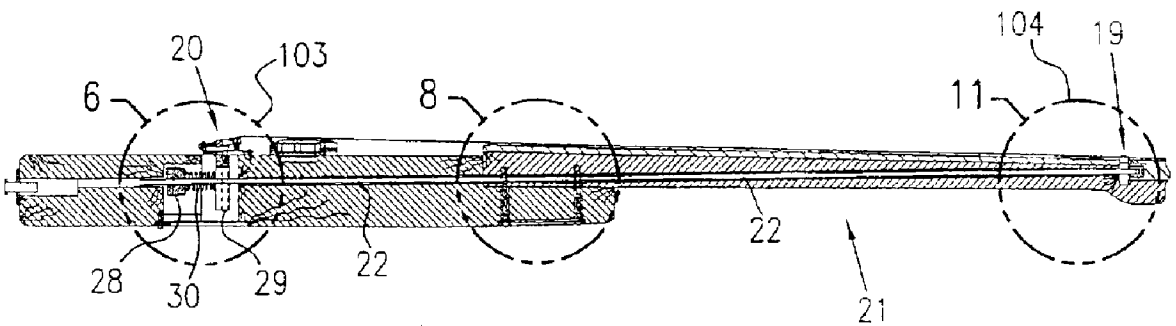
FIG. 5 is a partial longitudinal vertical sectional view of the instrument shown in FIG. 2, taken generally on line 5—5 of FIG. 2.

Guitars known in the prior art have strings supported by an independent top-nut on the neck and a bridge on the body, the top-nut and bridge separated by a mass of wood, which causes a dampening effect. As shown in FIG. 5, guitar 15 has a truss 21 between bridge 20 and top-nut 19 that integrates bridge 20 and top-nut 19 and provides a more efficient pathway for the movement of energy and vibrations.

Truss 21 includes a truss rod 22. Truss rod 22 is a solid cylindrical member elongated along axis x—x and is threaded at both ends. Truss rod 22 engages top-nut 19 at connection 104 and engages bridge 20 at connection 103. One threaded end of truss rod 22 engages a tremolo tension nut 28 and the other threaded end of truss rod 22 engages a truss rod adjustment nut 38. As shown, truss rod 22 extends through aligned longitudinally extending throughbores in neck 18 and body 16.

Figure 6:
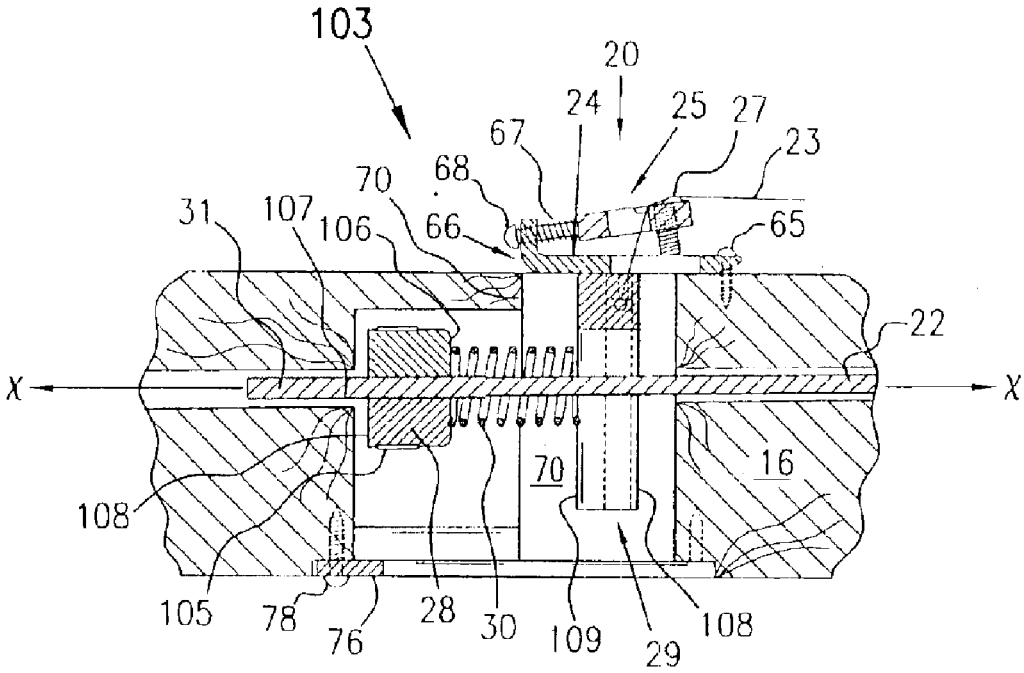
FIG. 6 is an enlarged detailed view of the tremolo assembly shown in FIG. 5, taken within the indicated circle of FIG. 5.
Figure 7:
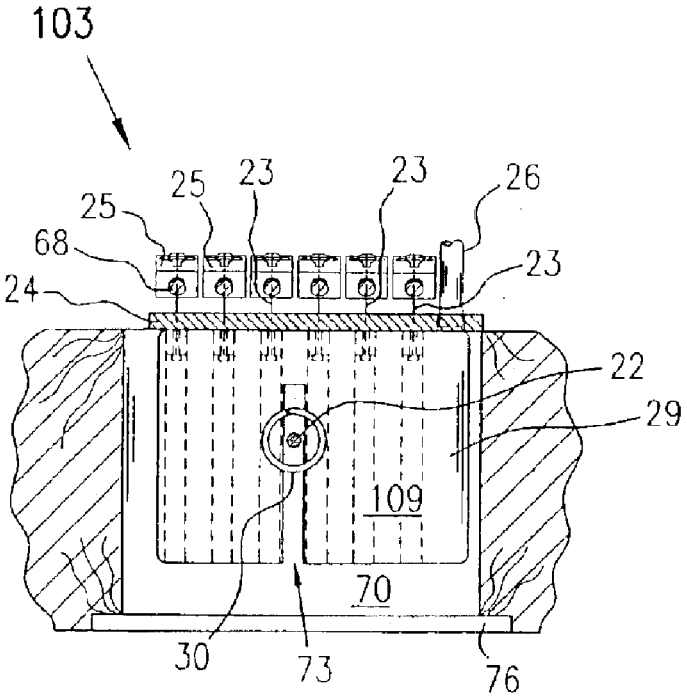
FIG. 7 is a partial transverse vertical sectional view of the instrument shown in FIG. 3, taken generally on line 7—7 of FIG. 3.

FIG. 6 is an enlarged detailed view of connection 103, taken within the indicated circle of FIG. 5. As shown in FIGS. 4–7, connection 103 generally comprises tremolo tension nut 28, tremolo block 29, tremolo tension spring 30, and bridge base 24.

Tremolo tension nut 28 is a cylindrical ring-shaped annular structure elongated along axis x—x and bounded by an outwardly-facing horizontal cylindrical surface 105, a rightwardly-facing annular vertical surface 106, a threaded inwardly-facing horizontal cylindrical surface 107, and a leftwardly-facing annular vertical surface 108. The left end portion 31 of truss rod 22 is threaded and surface 107 is provided with threads corresponding to portion 31. Accordingly, rotation of tremolo tension nut 28 causes axial movement of tension nut 28 along portion 31 of truss rod 22.

Depending upon the direction of rotation of tension nut 28, rotation of tension nut 28 increases or decreases the bias of spring 30. Thus, the force exerted by spring 30 is a function of the longitudinal position of tension nut 28 on truss rod 22.

Base plate 24 is a rectangular plate member having a bottom surface substantially parallel to the top surface of body 16. The right edge of base plate 24 is attached to body 16 with bridge mounting screws 65. Body 16 includes a cavity 70 extending transverse to axis x—x. Base plate 24 overlays and partially covers the top opening of cavity 70.

Block 29 is secured to the underside of plate 24 and extends into cavity 70. Block 29 is a rectangular member having a rightwardly-facing transverse vertical planar surface 108 and a leftwardly-facing transverse vertical planar surface 109. A vertical slot 73 extends through block 29 perpendicular to surfaces 108 and 109. The width of slot 73 is slightly greater than the diameter of truss rod 22 and is less than the inside diameter of the coils in spring 30.

Truss rod 22 extends through slot 73 perpendicular to surfaces 108 and 109 of block 29. As shown, the left surface 109 of block 29 and the right surface 106 of nut 28 are generally in a parallel orientation. Spring 30 is positioned between and supported by surfaces 106 and 109 respectively. Spring 30 is a coiled spring having a central axis of elongation x—x. Truss rod 22 extends through the center of spring 30. As indicated, the tension in spring 30 may be adjusted with rotation of adjustment nut 28 about axis x—x. When nut 28 is rotated for axial movement to the right, the distance between surfaces 106 and 109 decreases, causing the force exerted on block 29 to increase. Alternatively, when nut 28 is rotated for axial movement to the left, the distance between surfaces 106 and 109 increases, causing the bias exerted on block 29 to decrease. In the preferred embodiment, spring 30 is in compression between surfaces 106 and 109.

Bridge 20 includes tremolo 60, sectional saddles 25, intonation tension screws 68, intonation tension springs 67 and saddle height adjustment screws 69. The left edge of plate 24 has an upwardly curved flange portion 66. Base plate 24 is secured to body 16 with mounting screws 65 such as to permit limited pivotal movement of base plate 24. Saddle height adjustment screws 69, one for each of strings 23, extend forwardly through saddles 25 and are screw threaded into sectional saddles elements 25. Height adjustment screws 69 bear against the top of base plate 24. Block 29 is provided with a plurality of vertically-extending bores, one for each of strings 23. Each string 23 passes over a corresponding saddle element 25, and into a corresponding bore by way of a hole in base plate 24. The end of each of strings 23 connects to an anchor element in block 29.

A tremolo arm 26 is secured to the side of base plate 24. In normal playing position, arm 26 is disposed above the plane of strings 23 and below the lowest string 23 so as to be received in the palm of the players hand when in a position to strike the strings. If arm 26 is pivoted to or away from the body of the player during vibration of any or all the strings, a conventional tremolo effect will be produced by each of the vibrating strings. With movement of nut 28, the tension in spring 30 can be adjusted to assure that unless tremolo arm 28 is manually osculated there is no tendency for block 29 to vibrate when the strings are plucked. Thus, no tremolo effect occurs except at the will and direction of the player.

Access to cavity 70 is provided through an opening in the underside of body 16. When in use, this opening is covered with tremolo cover plate 76. Tremolo cover plate 76 is attached to the underside of body 16 with tremolo cover plate screws 78. When the player desires to adjust the force of spring 30, cover plate 76 is removed to allow access and appropriate rotation of nut 28 and movement of nut 28 along truss rod 22.

Figure 11:
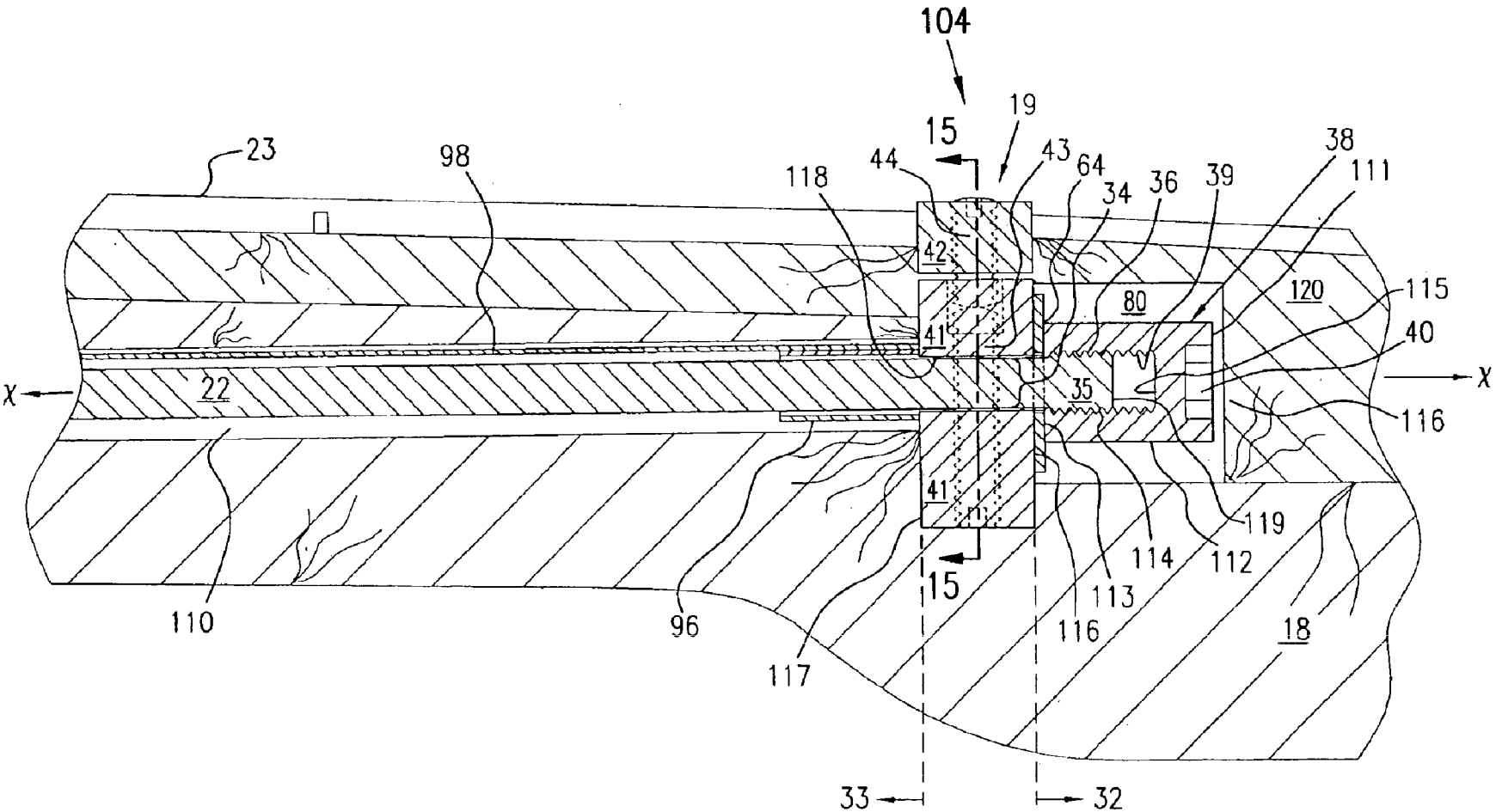
FIG. 11 is an enlarged detailed view of the top-nut assembly shown in FIG. 5, taken within the indicated circle of FIG. 5.

FIG. 11 is an enlarged detailed view of connection 104, taken within the indicated circle of FIG. 5. As shown in FIG. 5 and FIG. 11, connection 104 generally comprises top-nut 19, washer 64 and truss rod adjustment nut 38.

Truss rod adjustment nut 38 is a cylindrical shaped structure elongated along axis x—x and generally bounded by a rightwardly-facing annular vertical surface 111, an outwardly-facing horizontal cylindrical surface 112, a leftwardly-facing annular vertical surface 113, a threaded inwardly-facing horizontal cylindrical surface 114, and a leftwardly-facing circular vertical planar surface 115. The right end portion 35 of truss rod 22 is threaded and surface 114 is provided with threads corresponding to portion 35.

Top-nut 19 is generally a rectangular solid member split horizontally into an upper portion 42 and a lower portion 41. Upper portion 42 is bounded by a right vertical surface, a left vertical surface, a bottom horizontal surface, a front vertical surface, a rear vertical surface (not shown) and a top horizontal surface. Top surface of portion 42 has longitudinally extending grooves cut into it, one groove for each of strings 23.

Lower portion 41 is bounded by a right vertical surface 116, a left vertical surface 117, a front vertical surface, a rear vertical surface (not shown), a bottom horizontal surface, a top horizontal surface, and an inwardly-facing horizontal cylindrical surface 118. Surface 118 defines a through-passage 35 between surfaces 116 and 117. The diameter of passage 35 is slightly greater than the diameter of truss rod 22. The end of truss rod 22 extends through passage 35 such that a threaded portion 35 of truss rod 35 extends to the right of surface 116 of top-nut 19.

Top-nut 19 is inset in a transverse slot in neck 18. A longitudinal cylindrical bore 80 in neck 18 houses washer 64, tension adjustment nut 38 and the end portion 35 of truss rod 22. Washer 64 is placed on truss rod 22 between surface 116 of portion 41 of top-nut 19 and surface 113 of tension adjustment nut 38. Left vertical surface 117 of lower portion 41 abuts the rightwardly-facing vertical surface of the slot in neck 18. Thus, lower portion 41 bears against a vertical surface of neck 18 such that lower portion 41 is restrained from moving to the left. This allows for the tensioning of truss rod 22 with rotation of adjustment nut 38.

Adjustment nut 38 engages the threaded end portion 35 of truss rod 22 that extends to the right of surface 116 of top-nut 19. Accordingly, rotation of adjustment nut 38 about axis x—x causes axial movement of adjustment nut 38 along portion 35 of truss rod 22. Depending upon the direction of rotation, rotation of adjustment nut 38 causes the rightwardly-facing vertical circular planar surface 119 of truss rod 22 to move towards or away from surface 115 of adjustment nut 38. Such rotation of adjustment nut 38 increases or decreases the tension in truss rod 22. Since truss rod 22 acts in the preferred embodiment to counterbalance the flex of neck 18 caused by the pull of strings 23, such counterbalancing force can be adjusted with rotation of adjustment nut 38 about axis x—x. As indicated, a recess 40 is provided to allow for the rotation of attachment 38 with a properly configured tool.

Figure 15:
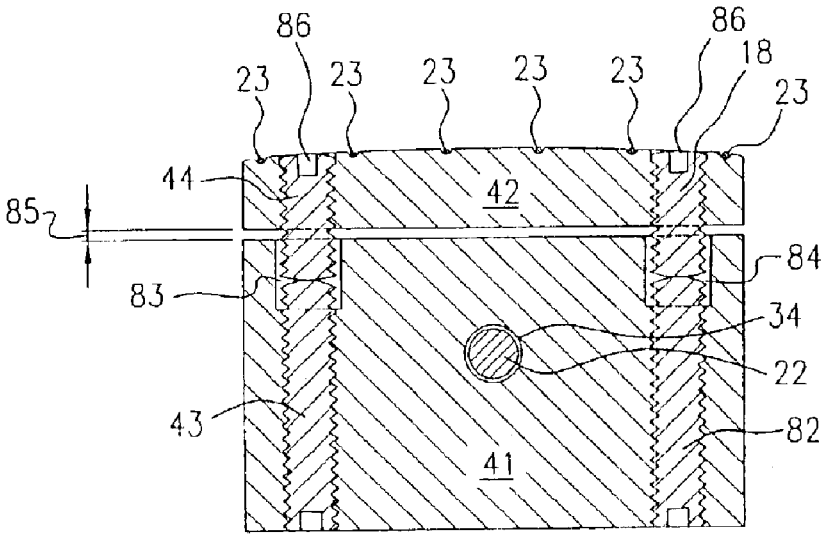
FIG. 15 is a partial transverse vertical sectional view of the top-nut shown in FIG. 11, taken generally on line 15—15 of FIG. 11.

Upper portion 42 of top-nut 19 is able to be adjusted vertically relative to lower portion 41 with rotation of threaded upper pins 44 and 81. As shown in FIG. 15, upper and lower portions 41 and 42 include two threaded bores extending vertically on either side of through passage 34. As indicated, the portion of these bores, 81 and 84 respectively, near the top surface of portion 41 are not threaded and have a diameter that is greater than the outside threaded diameter of pins 81, 44, 82 and 43. Pins 41 and 81 are in threaded engagement with upper portion 42 of top-nut 19, and pins 43 and 82 are in threaded engagement with lower portion 41 of top-nut 19. The lower rounded surface of pin 44 is in bearing relationship with the upper rounded surface of pin 43, and the lower rounded surface of pin 81 is in bearing relationship with the upper rounded surface of pin 82. Pins 44 and 43 and 81 and 82, respectively, bear against each other within bore portions 83 and 84, respectively. Accordingly, the space 85 between the bottom horizontal surface of portion 41 and the top horizontal surface of 42 may be adjusted such that the height of portion 42 above fretboard 101 may be adjusted. To increase the distance 85 between upper portion 42 and lower portion 41, and thereby increase the height of strings 23 above fretboard 101, pins 44 and 81 are rotated in a clockwise direction (looking down on the top of guitar 15) about their vertical axes. This provides movement of portion 41 in an upward direction relative to portion 41, as shown in FIG. 15, thereby increasing distance 85 and raising strings 23. This configuration of top-nut 19 allows for not only the adjustment of the height of strings 23 above fretboard 101, but also for easy replacement of upper portion 42 when upper portion 42 is overly worn due to the bearing of strings 23 in the grooves in upper portion 42. Furthermore, pins 43, 82, 44 and 81 may be easily replaced when worn.

As shown in FIG. 3 and FIG. 11, neck 18 includes a support member 120 mounted to headstock 58. Support member 120 compensates for any loss of strength in neck 18 caused by the increased depth of top-nut 19 set into neck 18 and braces against lateral movement of top-nut 19, particularly lateral movement of upper portion 42.

Figure 12:
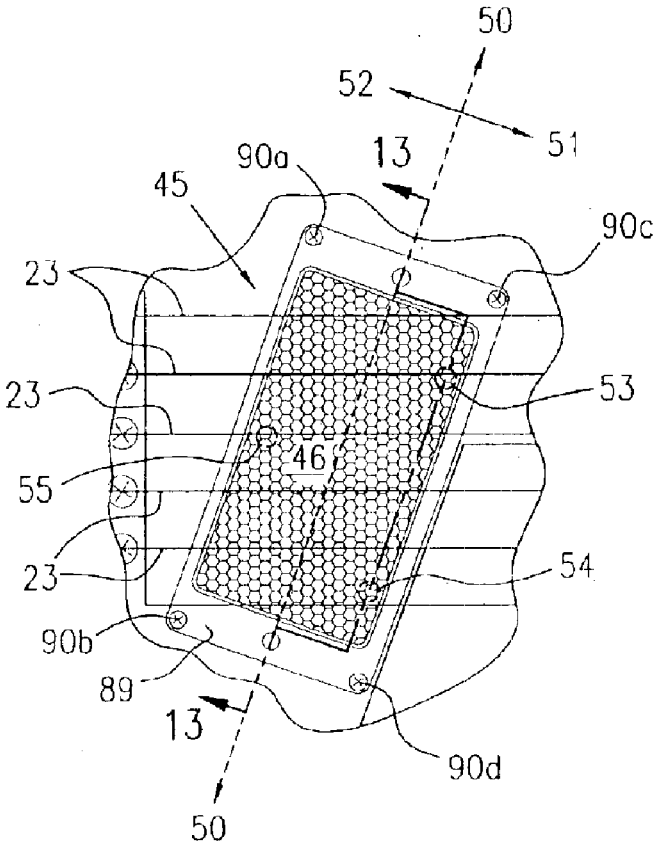
FIG. 12 is an enlarged detailed view of the pick-up shown in FIG. 2, taken within the indicated circle of FIG. 2.
Figure 13:
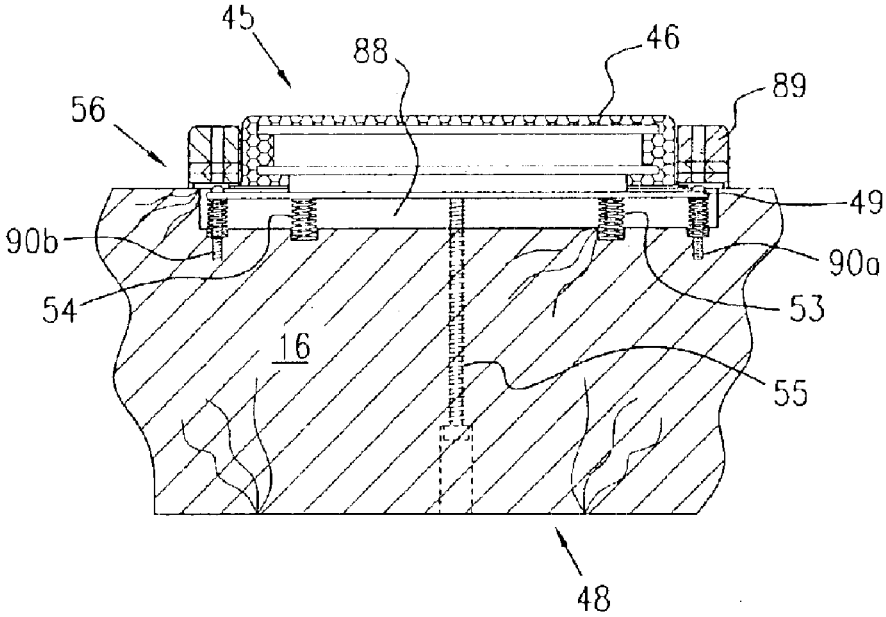
FIG. 13 is a partial vertical sectional view of the pick-up shown in FIG. 12, taken generally on line 13—13 of FIG. 12.

FIGS. 12 and 13 show pick-up 45 in the preferred embodiment. As shown in FIGS. 12–13, pick-up 45 includes a conventional magnetic pick-up mounted on a support plate 49. Body 16 is configured to receive a portion of pick-up 45 and includes a number of vertical holes and spring seats for receiving various screws and springs. Plate 49 is positioned over recess 88 and is held in place by mounting ring 89 and four mounting ring screws 90*a*–90*d*. Support plate 49 is configured to pivot about a pivot line 50. Two springs 53 and 54 are seated in the base of recess 88 on side 51 of pivot line 50. Springs 53 and 54 provide an upward bias against the bottom surface of plate 49 on side 51 of pivot line 50. A threaded adjustment bolt 55 extends through a correspondingly threaded vertical bore hole in base 16. The top end of adjustment bolt 55 extends into recess 88 and bears against the bottom surface of plate 88 on the opposite side 52 of pivot line 50 from side 51. Accordingly, rotation of bolt 55 around its vertical axis causes vertical axial movement of bolt 55. Depending upon the direction of rotation of bolt 55, rotation of bolt 55 increases or decreases the bias of springs 53 and 54. Thus, the force exerted by springs 53 and 54 is a function of the vertical position of bolt 55. FIG. 13 shows plate 49 in an untitled position, such that surface 46 is parallel to the plane of strings 23. However, when bolt 55 is rotated so as to provide axially vertical movement upward and to extend a greater portion of the end of bolt 55 into recess 88, surface 46 will tilt forward relative to the plane of strings 23. Alternatively, if bolt 55 is rotated so as to provide axially movement downward, springs 53 and 54 will bias the front edge of plate 49 in an upward direction so that surface 46 tilts backward relative to the plane of strings 23. Thus the angle of top surface 46 of pick-up 45 may be adjusted relative to the plane of two or more strings 23.

Figure 4:
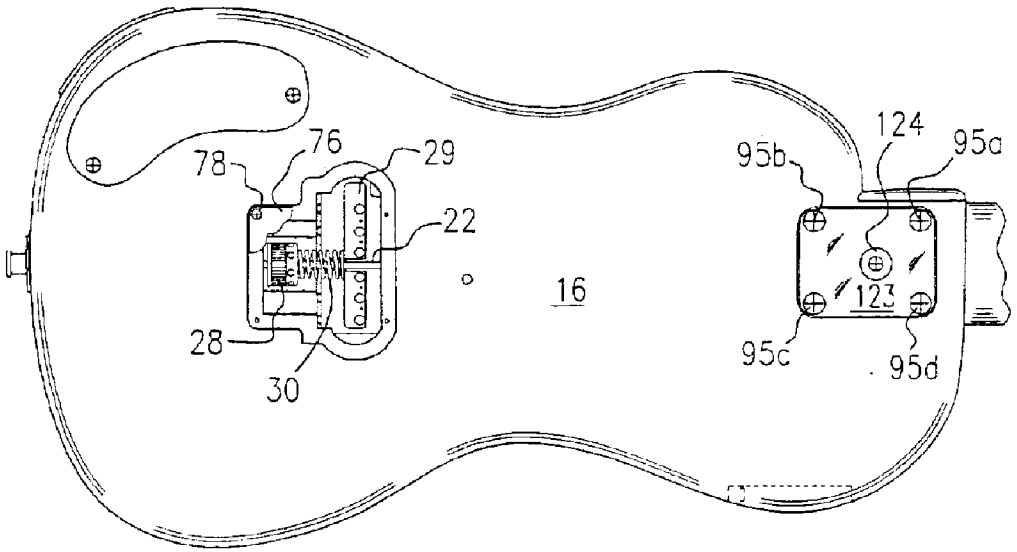
FIG. 4 is a bottom plan view of the indicated portion 4—4 of FIG. 3.
Figure 8:
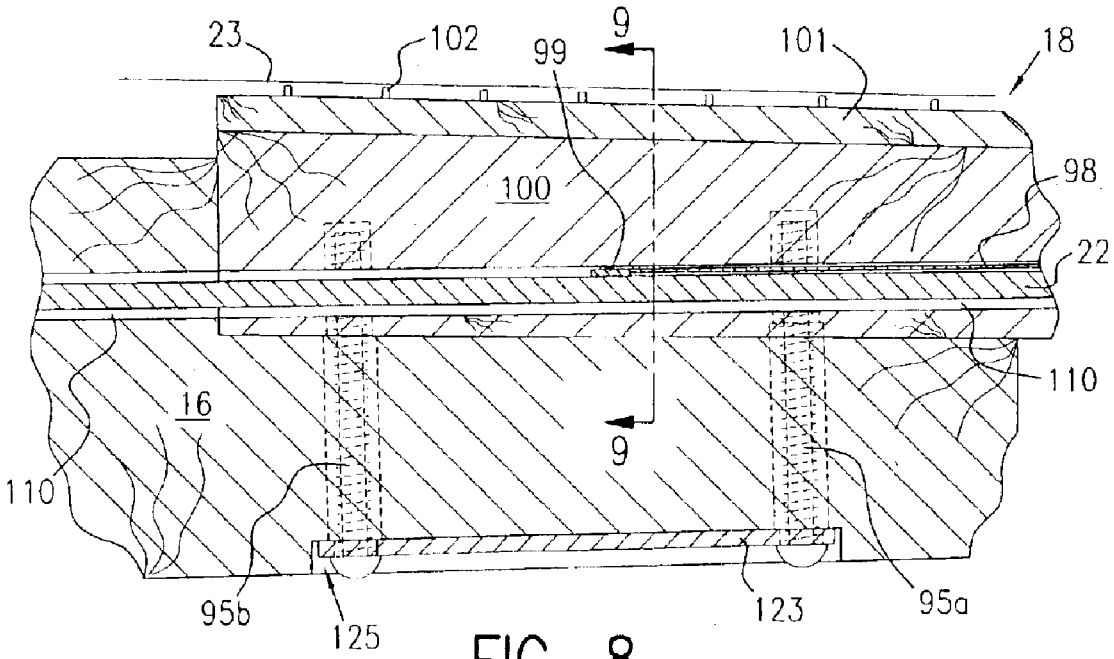
FIG. 8 is an enlarged detailed view of the neck mount shown in FIG. 5, taken within the indicated circle of FIG. 5.
Figure 9:
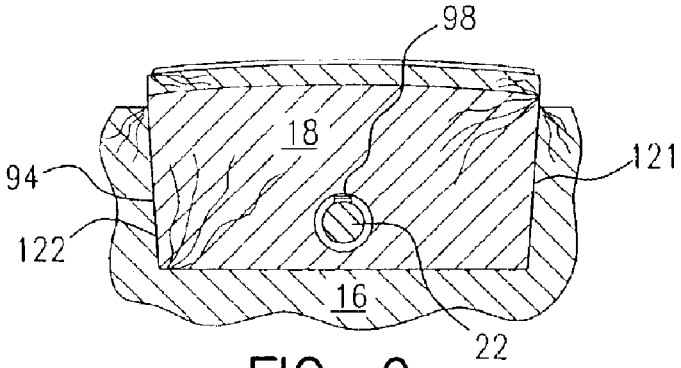
FIG. 9 is a partial transverse vertical sectional view of the neck mount shown in FIG. 8, taken generally on line 9—9 of FIG. 8.
Figure 10:
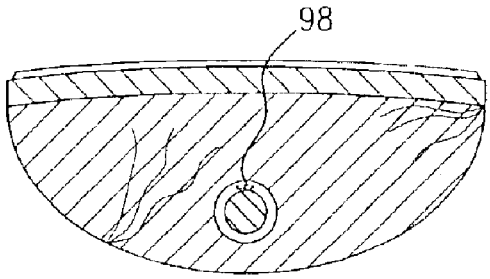
FIG. 10 is a transverse vertical sectional view of the instrument shown in FIG. 3, taken generally on line 10—10 of FIG. 3.

FIG. 8 and FIG. 9 show the connection between neck 18 and body 16, with truss rod 22 extending through the connection. Heel 100 of neck 18 has vertical untapered sides such that the bottom of heel 100 has a width equal to upper part of heel 100. However, body 16 has a pocket with tapered sides 121 and 122 such that the bottom of pocket 94 has a width less then the width at the top of pocket 94. This allows for snug seating of heel 100 in the tapered pocket 94 of body 16. Neck 18 is removably secured to body 16 with four threaded bolts 95. As shown in FIGS. 4 and 8, body 16 includes a recess 125 for receiving the ends of bolts 95 and neck plate 123. Thus, neck plate 123 and bolts 95 are recessed below the surface of body 16. As shown in FIG. 4, strap button 124 is mounted to the outside surface of neck plate 123.

As shown in FIGS. 8–11, truss 21 also includes a cylindrical sleeve 96 concentric to truss rod 22 and in sliding engagement with truss rod 22. Sleeve 96 extends around that portion of truss rod 22 immediately to the left of surface 117 of top-nut 19. To add additional counterbalancing strength to neck 18, a long and narrow plate 98 is positioned on top off sleeve 96 and generally parallel to truss rod 22. Plate 98 extends from surface 117 of top-nut 19 to a longitudinal point on truss rod 22 between bolts 95*a* and 95*b*. Plate 98 is welded at one end to sleeve 96 and is welded at its other end, as shown in FIG. 8, to truss rod 22 at weld 99.

Figure 14:
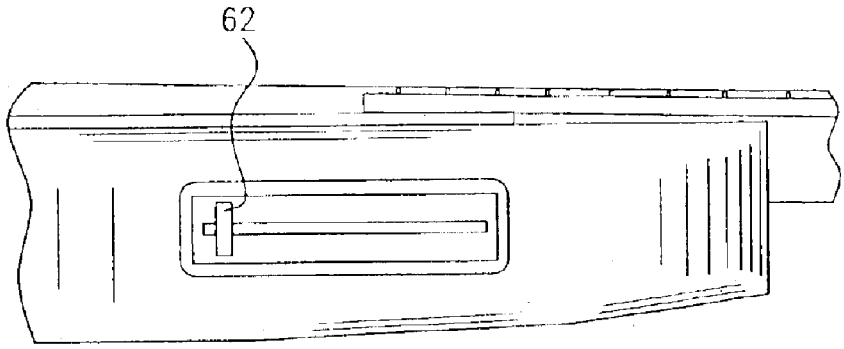
FIG. 14 is a side elevation of the indicated portion 14—14 of FIG. 2.

FIG. 14 shows slide style master volume control 62 employed in the preferred embodiment. As indicated in FIG. 2, control 62 is mounted on the top right shoulder of body 16 such that a player can easily determine visually how high the instrument is turned up.

Because of the mechanical engagement of truss rod 22 with top-nut 19 and bridge 20, the truss provides improved management of kinetic energy within the instrument. This improved management of kinetic energy results in a greater sustain of notes when played.

The present invention contemplates that many changes and modifications may be made. The particular materials of which the various body parts and component parts are formed are not deemed critical and may be readily varied. Therefore, while the presently preferred form of the instrument has been shown and described, and several modifications discussed, persons skilled in this art will readily appreciate that various additional changes and modification may be made without departing from the spirit of the invention, as defined and differentiated by the following claims.

What is claimed is:

1. A stringed instrument comprising:

a body;

an elongated neck connected to said body;

a top-nut supported by said neck;

a bridge supported by said body;

a plurality of strings mounted in tension relationship over at least a portion of said neck and said body and supported at least in part by said top-nut and said bridge;

a truss complying a truss rod extending longitudinally between said top-nut and said bridge and a truss force-transfer member mounted to said truss rod;

said bridge comprising a base secured to said body, a saddle for receiving said strings, an arm configured and arranged to pivot said saddle in a first direction for decreasing the tension in said string, and a saddle force-transfer member; and a spring acting between said truss force-transfer member and said saddle force-transfer member;

whereby said truss is in mechanical engagement with said bridge and said top-nut.

2. The stringed instrument set forth in claim 1, wherein said spring is in compression between said truss force-transfer member and said saddle force-transfer member.

3. The stringed instrument set forth in claim 1, wherein pivotal movement of said saddle in said first direction causes a compression force on said spring.

4. The stringed instrument set forth in claim 1, wherein said truss force-transfer member is adjustably mounted for longitudinal movement along at least a portion of said truss rod and the force of said spring is a function of the longitudinal position of said truss force-transfer member on said truss rod.

5. The stringed instrument set forth in claim 1, wherein said spring is a coiled spring and said truss rod extends along the centerline of said coil.

6. A stringed instrument comprising:

a body;

an elongated neck connected to said body;

a top-nut supported by said neck;

a bridge supported by said body;

a plurality of strings mounted in tension relationship over at least a portion of said neck and said body and supported at least in part by said top-nut and said bridge;

a truss rod extending longitudinally between and in mechanical engagement with said top-nut and said bridge;

said top-nut comprising a head side, an opposing neck side and a through-passage between said sides;

said truss rod extending through said through-passage and having a portion projecting on said head side;

said projecting portion of said truss rod on said head side threaded to receive a correspondingly threaded adjustment nut;

said adjustment nut in threaded engagement with said truss rod;

whereby the tension of said truss rod is adjusted by selective rotation of said adjustment nut.

7. The stringed instrument set forth in claim 6, wherein said adjustment nut has a threaded first portion and second portion comprising a recess for receiving a torque-producing tool.

8. The stringed instrument set forth in claim 6, wherein said top-nut comprises a lower portion secured to said neck and an upper portion adjustable relative to said lower portion.

9. The stringed instrument set forth in claim 8, and further comprising:

at least one upper pin;

said upper pin and said upper portion in threaded engagement such that said upper portion moves relative to said lower portion with selective rotation of said upper pin.

10. A stringed instrument comprising:

a body;

an elongated neck connected to said body;

a top-nut supported by said neck;

a bridge supported by said body;

a plurality of strings mounted in tension relationship over at least a portion of said neck and said body and supported at least in part by said bridge;

a truss in mechanical engagement with said bridge and said top-nut;

a pick-up supported by said body and positioned between said body and said strings;

said pick-up having a top surface; and a pick-up tilt adjustment mechanism for adjusting the angle of said top surface relative to the plane of said strings.

11. The stringed instrument set forth in claim 10, wherein said pick-up comprises a support plate configured to pivot about a pivot line and said tilt adjustment mechanism comprises at least one spring between said body and said support plate on a first side of said line and a selectively adjustable member between said body and said support plate on the opposite side of said line from said first side.

12. The stringed instrument set forth in claim 11, wherein said adjustable member and said body are in threaded engagement such that the force of said spring on said support plate is a function of the rotation of said adjustable member.

13. The stringed instrument set forth in claim 11, wherein said adjustable member and said body are in threaded engagement such that the angle of said top surface relative to said plane of said strings is a function of the rotation of said adjustable member.

14. The stringed instrument set forth in claim 10, and further comprising a height adjustment mechanism for adjusting the distance between said top surface and said plane of said strings.

* * * * *